US009004000B2

(12) United States Patent
Koga

(10) Patent No.: US 9,004,000 B2
(45) Date of Patent: Apr. 14, 2015

(54) GAS WIPING DEVICE

(71) Applicant: Nisshin Steel Co., Ltd., Tokyo (JP)

(72) Inventor: Shinichi Koga, Sakai (JP)

(73) Assignee: Nisshin Steel Co., Ltd., Tokyo (JP)

( * ) Notice: Subject to any disclaimer, the term of this patent is extended or adjusted under 35 U.S.C. 154(b) by 120 days.

(21) Appl. No.: 13/869,776

(22) Filed: Apr. 24, 2013

(65) Prior Publication Data

US 2013/0239884 A1 Sep. 19, 2013

Related U.S. Application Data

(63) Continuation of application No. PCT/JP2011/073883, filed on Oct. 18, 2011.

(30) Foreign Application Priority Data

Oct. 26, 2010 (JP) ..... 2010-239833
Oct. 14, 2011 (JP) ..... 2011-226293

(51) Int. Cl.

| | |
|---|---|
| ***B05C 11/06*** | (2006.01) |
| ***F26B 15/00*** | (2006.01) |
| ***C23C 2/00*** | (2006.01) |
| ***C23C 2/20*** | (2006.01) |
| ***C23C 2/06*** | (2006.01) |

(52) U.S. Cl.

CPC ..... *B05C 11/06* (2013.01); *F26B 15/00* (2013.01); *C23C 2/003* (2013.01); *C23C 2/20* (2013.01); *C23C 2/06* (2013.01)

(58) Field of Classification Search

None

See application file for complete search history.

(56) References Cited

U.S. PATENT DOCUMENTS

| | | | | |
|---|---|---|---|---|
| 4,321,884 | A * | 3/1982 | Barkley | 118/63 |
| 5,279,667 | A * | 1/1994 | Blankenship et al. | 118/63 |
| 8,113,139 | B2 * | 2/2012 | Kim et al. | 118/63 |

FOREIGN PATENT DOCUMENTS

| | | |
|---|---|---|
| JP | 62-193671 | 8/1987 |
| JP | 01-208441 | 8/1989 |
| JP | 06-158261 | 6/1994 |
| JP | 06-256923 | 9/1994 |
| JP | 09-143664 | 6/1997 |
| JP | 2005-60807 A | 3/2005 |
| JP | 2005-281799 | 10/2005 |

* cited by examiner

*Primary Examiner* — Dah-Wei D Yuan
*Assistant Examiner* — Jethro M Pence
(74) *Attorney, Agent, or Firm* — Tracy M. Helms; Apex Juris, PLLC

(57) ABSTRACT

A gas wiping device for preventing splash on a steel band including a box-shaped body enclosing the steel band and gas wiping nozzles is provided with a plating bath for storing molten metal, and a box-shaped body placed above the plating bath. The box-shaped body is provided, in the interior, with gas wiping nozzles disposed facing one another on the respective tubular members so as to sandwich a band-shaped body. Gas wiping nozzle is provided with a first spraying unit capable of spraying gas to the steel band, and a second spraying unit and a third spraying unit capable of spraying gas towards the direction of gas wiping nozzle. Gas wiping nozzle is provided with a fourth spraying unit capable of spraying gas to the steel band, and a fifth spraying unit and a sixth spraying unit capable of spraying gas towards the direction of gas wiping nozzle.

3 Claims, 5 Drawing Sheets

FIG. 2A
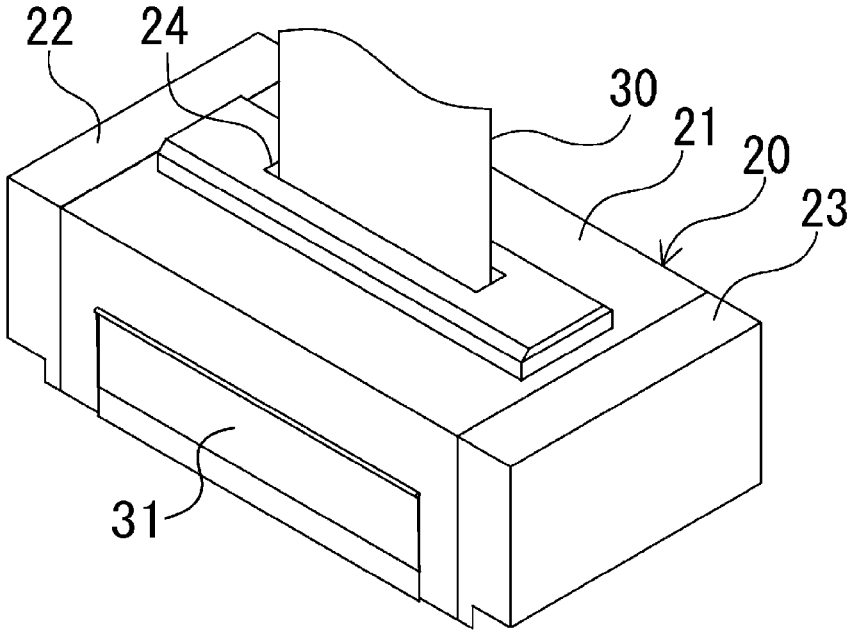
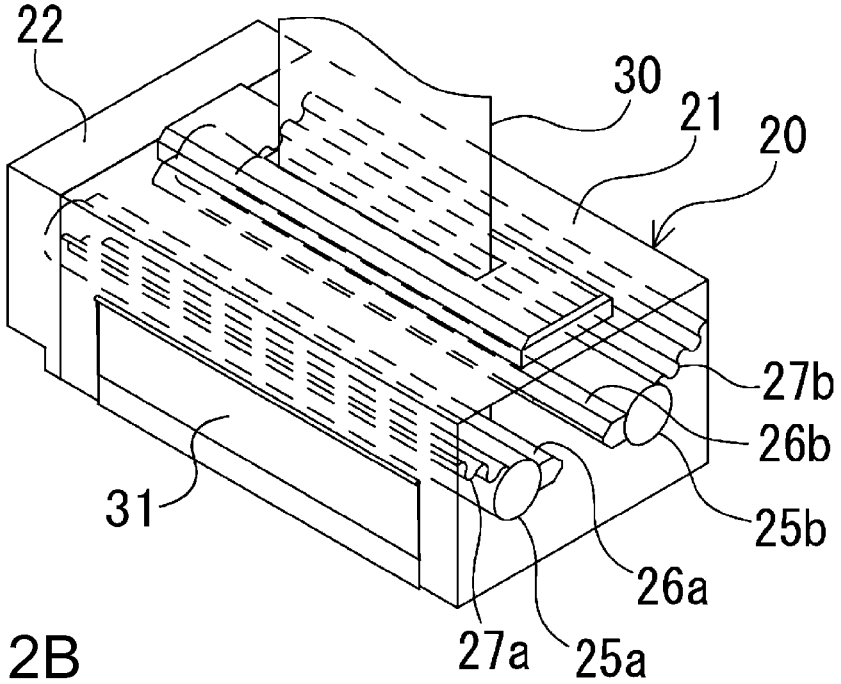
FIG. 2B

GAS WIPING DEVICE

CROSS REFERENCE TO RELATED APPLICATIONS

This is a continuation application of International Patent Application No. PCT/JP2011/073883 filed on Oct. 18, 2011 claiming priority upon Japanese Patent Application Nos. 2010-239833 and 2011-226293 filed on Oct. 26, 2010 and Oct. 14, 2011, respectively, of which full contents are incorporated herein by reference.

BACKGROUND OF THE INVENTION

1. Field of the Invention

The present invention relates to a gas wiping device configured to suppress the adhesion of splashes on a steel band.

2. Description of the Background Art

Among the gas wiping devices configured to control the thickness of plating formed on a steel band by spraying gas thereon subjected to immersion in molten metal, a device equipped with a sealed box to prevent surface roughness of the steel band has been conventionally known.

Such a type of gas wiping device has been configured to house a steel band and gas wiping nozzles to spray gas in a sealed box, and regulate the concentration of oxygen in the sealed box within a predetermined range (e.g. within 1%), thereby enabling prevention of surface roughness on the steel band. However, the gas wiping devices equipped with such sealed boxes, as compared to those without sealed boxes, have caused a notable adhesion of splashes on steel bands, which has resulted in an increase in the number of splash-induced spots.

In order to suppress the adhesion of splashes on steel bands, the gas wiping device disclosed in e.g. Patent Document 1 includes: an enclosure housing a band-shaped body (steel band) and gas wiping nozzles, and having an exit for the band-shaped body; a pair of baffle plates arranged in the enclosure so as to face each other across the band-shaped body, and further so as to contact the lower end face of at least one of the gas wiping nozzles, and still further so as to divide and partition the enclosure into upper and lower spaces while leaving an opening of the enclosure for allowing the band-shaped body to pass therethrough, where the upper space has the gas wiping nozzles arranged therein; and wiping gas outlets communicating with the lower space of the enclosure and connected to vacuum and exhaust means.

PRIOR ART DOCUMENTS

Patent Documents

Patent Document 1: Japanese Patent Application Publication No. S62-193671

Problems to be Solved

Recently, there have been growing examples where hot-dipped Zn—Al—Mg system plated steel sheets manufactured by using a Zn-plating bath containing appropriate amounts of Al and Mg are applied to a field of industries such as building materials, civil engineering and construction, housing, electrical machinery, and the like, because such plated steel sheets are more resistant to corrosion than other Zn system plated steel sheets.

For industrially manufacturing such a hot-dipped Zn—Al—Mg system plated steel sheet, it has been requested that the obtained hot-dipped plated steel sheets excel in corrosion resistance, and band-shaped products with high corrosion resistance and good surface appearance be manufactured at a high level of productivity.

In the Zn—Al—Mg ternary equilibrium phase diagram, the ternary eutectic point at which the melting point is the lowest (melting point=343° C.) is recognized in the vicinity of 4-wt % Al and 3-wt % Mg. However, bath compositions in the vicinity of the ternary eutectic point cause a local crystallization of $Zn_{11}Mg_2$ system phase (Al/Zn/$Zn_{11}Mg_2$ ternary eutectic matrix itself; $Zn_{11}Mg_2$ system phase of Al primary crystals mixed in the matrix; and/or $Zn_{11}Mg_2$ system phase of Al primary crystals and Zn single phase mixed in the matrix) to occur in the structure of the plating layer. Such a locally crystallized $Zn_{11}Mg_2$ system phase, as compared to the $Zn_2Mg$ system phase, is more easily subjected to discoloration. After having been left for a while, the discolored parts exhibit a noticeable color tone, and significantly deteriorate the surface appearance of hot-dipped Zn—Al—Mg system plated steel sheets. In addition, when such a $Zn_{11}Mg_2$ system phase is locally crystallized, the crystallized portion corrodes predominantly. Since hot-dipped Zn—Al—Mg system plated steel sheets, as compared to other Zn system plated steel sheets, have a beautiful glossy surface appearance, even tiny spots on the surface become noticeable and greatly degrade the value of the sheets as products.

The local crystallization of the $Zn_{11}Mg_2$ system phase on hot-dipped Zn—Al—Mg system plated steel sheets can be prevented by regulating, within appropriate ranges, the temperature of the plating bath and the velocity of cooling carried out after having completed plating (e.g. Japanese Patent Application Publication No. H10-226865). However, it has been recognized by the inventors of the present invention that, even when those conditions are regulated within appropriate ranges, splashes generated by gas wiping in a sealed box adhering on the steel band while the plated metal being in an unsolidified state after gas wiping cause crystallization of the $Zn_{11}Mg_2$ system phase to occur, and generate a spotty appearance; however, splashes adhering on the steel band while the plated metal being in an unsolidified state before gas wiping do not generate any spotty appearance because the splashes are re-melted.

In order to suppress the adhesion of splashes on the steel band after gas wiping, it is necessary to prevent splashes from moving toward the passage of the steel band located above a nozzle plane (an imaginary plane connecting between the tips of the gas wiping nozzles arranged to face each other) of the gas wiping nozzles. For this purpose, it is preferable that all parts are sealed in the sealed box, except the parts between the gas wiping nozzles arranged to face each other. In particular, the important problem to be solved is how to seal gaps at both ends in a width direction of the gas wiping nozzles arranged to face each other.

It can be considered that a blocking member is disposed to seal between one gas wiping nozzle and the other gas wiping nozzle facing each other as a possible way to seal gaps at both ends in the width direction of the gas wiping nozzles arranged to face each other.

However, regarding such a type of gas wiping device, the distance between the gas wiping nozzles arranged to face each other is changed for controlling the thickness of plating, and therefore, it is difficult to dispose the blocking member to seal between the gas wiping nozzles arranged to face each other. Further, the high temperature around the gas wiping nozzles may cause deformation of such a blocking member that would do harm to other parts (e.g. the deformed blocking member contacts the steel band, or the like). It is also to be noted that, in the gas wiping device in Patent Document 1, splashes move from both ends in the width direction of the gas wiping nozzles toward an area above the nozzle plane, and therefore, splashes cannot be prevented from adhering on the band-shaped body (steel band).

SUMMARY OF THE INVENTION

In view of the above, the object of the present invention is to provide a gas wiping device including a box-shaped body housing gas wiping nozzles, which device is capable of suppressing the adhesion of splashes on a steel band subjected to gas wiping.

Means for Solving Problems (1) A gas wiping device according to the present invention includes: a first gas wiping nozzle and a second gas wiping nozzle arranged to face each other across a steel band pulled up from a molten-metal plating bath, the first and second gas wiping nozzles capable of removing excess molten metal adhering on a surface of the steel band; a first tubular member disposed along a width direction of the steel band, the first tubular member connected to the first gas wiping nozzle; a second tubular member disposed along a width direction of the steel band, the second tubular member connected to the second gas wiping nozzle; a box-shaped body housing the first and second gas wiping nozzles, and the first and second tubular members; a first partition member having one end thereof fixed to an outer wall of the first tubular member, and having the other end thereof fixed to an inner wall of the box-shaped body; and a second partition member having one end thereof fixed to an outer wall of the second tubular member, and having the other end thereof fixed to an inner wall of the box-shaped body, wherein the first gas wiping nozzle includes a first spraying segment capable of spraying gas over a range as a whole in a width direction of the steel band, a second spraying segment capable of spraying gas toward the second gas wiping nozzle over a range from one end of the first spraying segment to one inner wall of the box-shaped body in a width direction of the box-shaped body, and a third spraying segment capable of spraying gas toward the second gas wiping nozzle over a range from the other end of the first spraying segment to the other inner wall of the box-shaped body in a width direction of the box-shaped body, and wherein the second gas wiping nozzle includes a fourth spraying segment capable of spraying gas over a range as a whole in a width direction of the steel band, a fifth spraying segment capable of spraying gas toward the first gas wiping nozzle, from over a range from one end of the fourth spraying segment to one inner wall of the box-shaped body in a width direction of the box-shaped body, and a sixth spraying segment capable of spraying gas toward the first gas wiping nozzle over a range from the other end of the fourth spraying segment to the other inner wall of the box-shaped body in a width direction of the box-shaped body.

According to the gas wiping device having the structures of (1) above, the first partition member seals a gap between an outer wall of the first tubular member and an inner wall of the box-shaped body, and the second partition member seals a gap between an outer wall of the second tubular member and an inner wall of the box-shaped body. In other words, the device can prevent splashes from passing through a gap between the first tubular member and an inner wall of the box-shaped body or a gap between the second tubular and the inner wall of the box-shaped body toward the passage of the steel band located above the nozzle plane connecting in an imaginary fashion between the tip of the first gas wiping nozzle and the tip of the second gas wiping nozzle. Furthermore, the device can prevent splashes from passing through a gap between the first and second gas wiping nozzles at both ends in the width direction thereof toward the passage of the steel band located above the nozzle plane. In other words, splashes generated below the nozzle plane can be prevented from passing through the areas except for the nozzle widths of the first and second gas wiping nozzles arranged to face each other toward the passage of the steel band located above the nozzle plane. Therefore, even when equipped with a box-shaped body housing the first and second gas wiping nozzles, the device can suppress the adhesion of splashes on the surface of the steel band after excess molten metal is removed from the surface of the steel band by the first and second gas wiping nozzles. In spite of high temperature around the gas wiping nozzles, the device can prevent e.g. the occurrence of a situation in which a deformed member contacts the steel band when a blocking member is arranged to seal a gap between a gas wiping nozzle and the other gas wiping nozzle.

(2) For the gas wiping device having the structures of (1), it is preferable that the second and third spraying segments are configured such that gas sprayed therefrom is smaller in amount than gas sprayed from the first spraying segment, and that the fifth and sixth spraying segments are configured such that gas sprayed therefrom is smaller in amount than gas sprayed from the fourth spraying segment.

According to the gas wiping device having the structures of (2) above, the second, third, fifth, and sixth spraying segments spray gas for the purpose of sealing instead of gas-spraying on the steel band, thereby enabling to regulate a spraying amount of gas so as to suppress excessive gas consumption while preventing splashes at both ends in the width direction of the first and second gas wiping nozzles from passing toward the passage of the steel band located above the nozzle plane.

(3) For the gas wiping device having the structures of (1) or (2) above, it is preferable that at least one of the first and second gas wiping nozzles is movable relative to the other while being in parallel with the other so that a distance therebetween can be changed within a predetermined range, and that the gas wiping device further comprises a gas regulating unit configured to regulate a spraying amount of gas in such a fashion that, in accordance with a distance between the first and second gas wiping nozzles, gas sprayed from the second spraying segment and gas sprayed from the fifth spraying segment contact each other, and gas sprayed from the third spraying segment and gas sprayed from the sixth spraying segment contact each other.

According to the gas wiping device having the structures of (3) above, even when the distance between the first and second gas wiping nozzles is the maxim distance, splashes can be prevented at both ends in the width direction of the gas wiping nozzles from moving toward the passage of the steel band located above the nozzle plane while excessive gas consumption being suppressed. In particular, even when at least one of the first and second gas wiping nozzles is movable relative to the other while being in parallel with the other, gaps on both sides in the width direction of the steel band are sealed by gas, and therefore, splashes can be prevented from moving toward the passage of the steel band located above the nozzle plane at all times irrespective of the distance between the first and second gas wiping nozzles.

Advantageous Effects of the Invention

According to the device of the present invention used as a gas wiping device configured to control the thickness of plating formed on the steel band by spraying gas thereon subjected to immersion in molten metal, splashes can be prevented from moving to the exit side of the gas wiping nozzles, and the adhesion of splashes on the steel band subjected to gas wiping can be suppressed, which results in a great reduction of defects in the surface appearance of the steel band caused by splash adhesion. In particular, for hot-dipped Zn—Al—Mg system plated steel sheets, splashes adhere on the steel band with unsolidified plated metal subjected to gas wiping, which causes crystallization of $Zn_{11}Mg_2$ system phase leading to a spotty appearance. The gas wiping device according to the present invention can certainly reduce the occurrence of a spotty appearance as well as suppress the decrease of corrosion resistance. In hot-dipped Zn—Al—Mg system plated steel sheets, even when splashes adhere on the steel band with unsolidified plated metal before gas wiping, a spotty appearance is not generated because those splashes are re-melted. Therefore, the gas wiping device according to the present invention does not need vacuum means, exhaust means, or guide plates for gas containing splashes in the lower space located below the gas wiping nozzles, such as those described in prior art literature (Japanese Patent Application Publication S62-193671), thereby realizing a simple structure with no increase in seal gas consumption.

BRIEF DESCRIPTION OF THE DRAWINGS

For more thorough understanding of the present invention and advantages thereof, the following descriptions should be read in conjunction with the accompanying drawings, in which:

FIG. 2A is a perspective view for depicting a box-shaped body in the gas wiping device shown in FIG. 1.

FIG. 2B is a perspective view for explaining the internal structure of the box-shaped body shown in FIG. 2A.

DESCRIPTION OF EMBODIMENTS OF THE INVENTION

Hereinafter, a gas wiping device as an embodiment of the present invention will be described with reference to the drawings.

Figure 1:
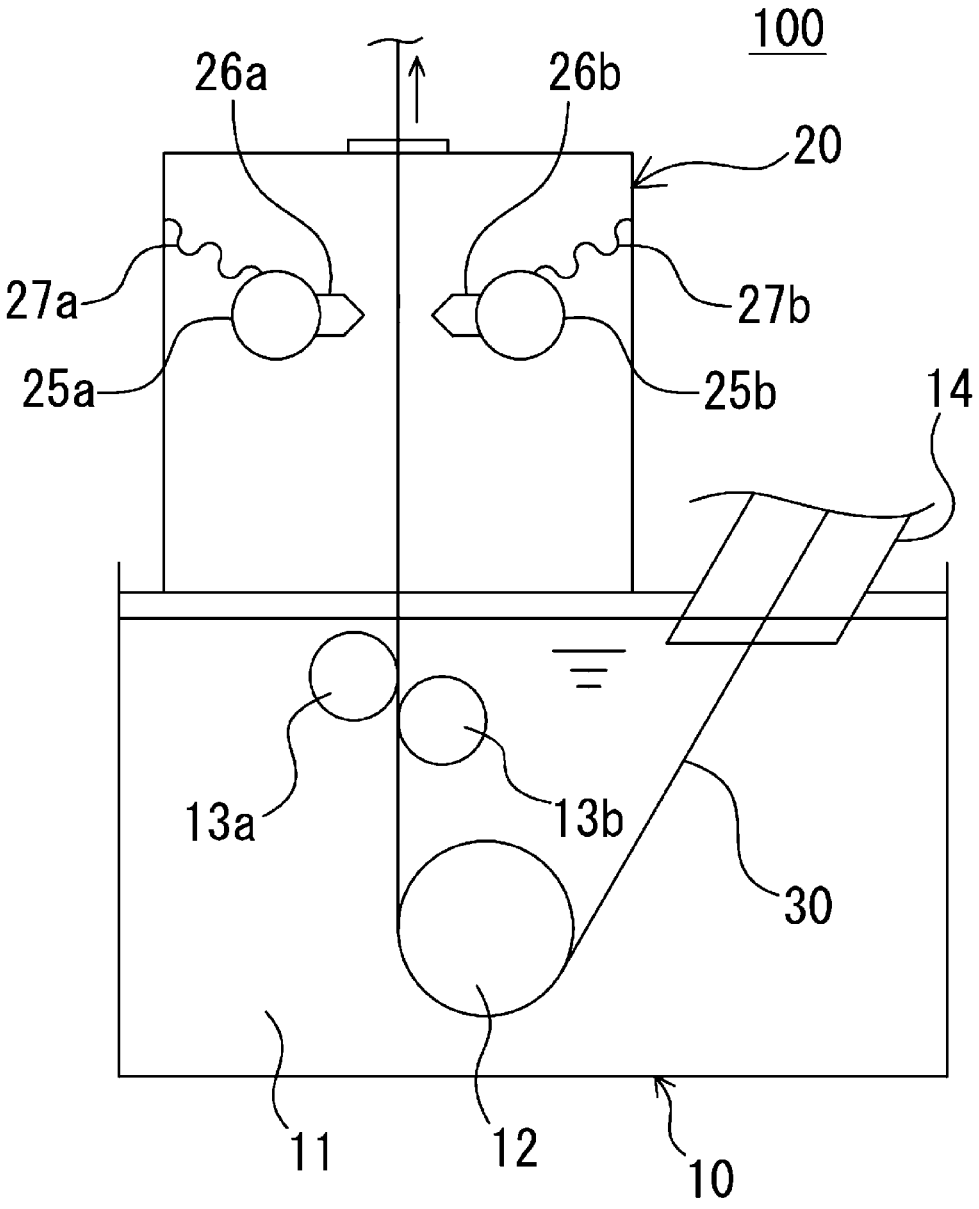
FIG. 1 is a schematic diagram of a gas wiping device as an embodiment of the present invention.

As shown in FIG. 1, a gas wiping device 100 as an embodiment of the present invention is installed on a plating bath 10 having molten metal 11 stored therein, and has a box-shaped body 20 disposed on top of the plating bath 10.

Inside the plating bath 10, there are disposed: a main-roller 12 and sub-rollers 13*a*, 13*b* for drawing and supporting a steel band 30 upward from the plating bath 10; and an inlet 14 for conveying the steel band 30 from the outside (e.g. a furnace) into the plating bath 10.

As shown in FIG. 2A, the box-shaped body 20 includes: a main body 21 having substantially a tubular shape; end caps 22, 23 for closing both ends in a width direction of the main body 21; and an outlet 24 for sending the steel band 30 plated with molten metal from the inside thereof to the outside thereof. The box-shaped body 20 is equipped with a sealing curtain 31 that is closed to ensure hermeticity during manufacturing of plated steel bands and opened at the time of discharging of dross in such a sealed box.

Furthermore, as shown in FIGS. 1 and 2B, the gas wiping device 100 includes inside the box-shaped body 20: tubular members 25*a*, 25*b* disposed along the width direction of the steel band 30; gas wiping nozzles (a first gas wiping nozzle 26*a* and a second gas wiping nozzle 26*b*) connected respectively to the tubular members 25*a*, 25*b* in such a fashion that the gas wiping nozzles face each other across the steel band 30; and accordion curtains 27*a*, 27*b* having their respective first ends fixed respectively to outer walls of the tubular members 25*a*, 25*b*, and having their respective second ends fixed respectively to inner walls of the box-shaped body 20.

Figure 3:
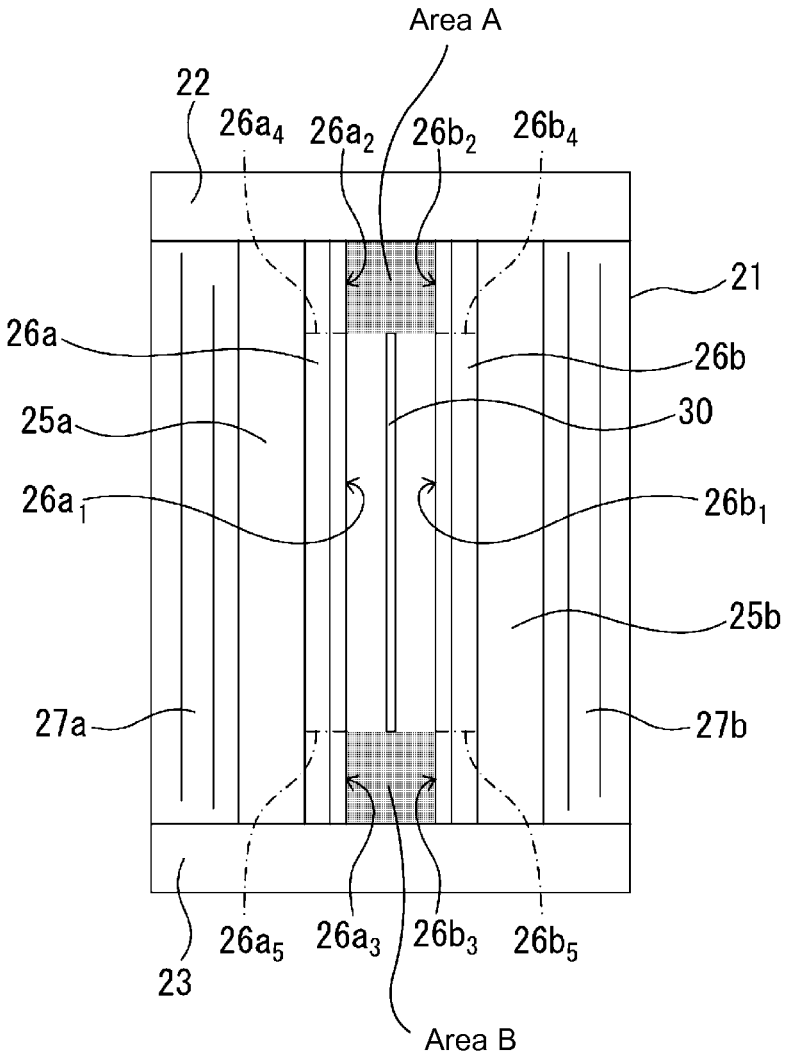
FIG. 3 is a transparent top view of the box-shaped body in the gas wiping device shown in FIG. 1.

The gas wiping nozzle 26*a* has nozzles each having a slit of predetermined width formed thereon, which make it possible to spray gas over substantially whole areas in the width direction inside the box-shaped body 20, and includes a first spraying segment $\mathbf{26}a_1$ (between imaginary lines $\mathbf{26}a_4$, $\mathbf{26}a_5$ in FIG. 3), a second spraying segment $\mathbf{26}a_2$ (between imaginary line $\mathbf{26}a_4$ and the inner wall of the end cap 22 of the box-shaped body 20 in FIG. 3) and a third spraying segment $\mathbf{26}a_3$ (between imaginary line $\mathbf{26}a_5$ and the inner wall of the end cap 23 of the box-shaped body 20 in FIG. 3).

The first spraying segment $\mathbf{26}a_1$ serves as removing excess molten metal adhering on the surface (opposed to the first spraying segment $\mathbf{26}a_1$) of the steel band 30, and is configured such that it is capable of spraying gas over the full width of the steel band 30. The second spraying segment $\mathbf{26}a_2$ is configured such that it is capable of spraying gas toward the gas wiping nozzle 26*b* from one end of the first spraying segment $\mathbf{26}a_1$ to the inner wall of the end cap 22 of the box-shaped body 20 in the width direction. The third spraying segment $\mathbf{26}a_3$ is configured such that it is capable of spraying gas toward the gas wiping nozzle 26*b* from the other end of the first spraying segment $\mathbf{26}a_1$ to the inner wall of the end cap 23 of the box-shaped body 20 in the width direction.

The first, second, and third spraying segments $\mathbf{26}a_1$, $\mathbf{26}a_2$, $\mathbf{26}a_3$ are defined according to the size of the steel band 30 in the width direction. The positions (boundaries), by which the first, second, and third spraying segments $\mathbf{26}a_1$, $\mathbf{26}a_2$ $\mathbf{26}a_3$ are separated, are changed depending on the size of the steel band 30 in the width direction.

In a similar fashion to that of the gas wiping nozzle 26*a*, the gas wiping nozzle 26*b* has nozzles capable of spraying gas over the whole areas in the width direction inside the box-shaped body 20, and has a fourth spraying segment $\mathbf{26}b_1$ (between imaginary lines $\mathbf{26}b_4$ and $\mathbf{26}b_5$ in FIG. 3), a fifth spraying segment $\mathbf{26}b_2$ (between imaginary line $\mathbf{26}b_4$ and the inner wall of the end cap 22 of the box-shaped body 20 in FIG. 3), and a sixth spraying segment $\mathbf{26}b_3$ (between imaginary line $\mathbf{26}b_5$ and the inner wall of the end cap 23 of the box-shaped body 20 in FIG. 3).

The fourth spraying segment $\mathbf{26}b_1$ serves as removing excess molten metal adhering on the surface (opposed to the fourth spraying segment $\mathbf{26}b_1$) of the steel band 30 and is configured such that it is capable of spraying gas over the full width of the steel band 30. The fifth spraying segment $\mathbf{26}b_2$ is configured such that it is capable of spraying gas toward the gas wiping nozzle 26*a* from one end of the fourth spraying segment $\mathbf{26}b_1$ to the inner wall of the end cap 22 of the box-shaped body 20 in the width direction. The sixth spraying segment $\mathbf{26}b_3$ is configured such that it is capable of spraying gas toward the gas wiping nozzle 26*b* from the other end of the fourth spraying segment $\mathbf{26}b_1$ to the inner wall of the end cap 23 of the box-shaped body 20 in the width direction.

In a similar fashion to that of the first, second, and third spraying segments $\mathbf{26}a_1$, $\mathbf{26}a_2$, $\mathbf{26}a_3$, the fourth, fifth, and sixth spraying segments 26$b_1$, 26$b_2$, 26$b_3$ are defined according to the size of the steel band 30 in the width direction. The positions (boundaries), by which separating the fourth, fifth, and sixth spraying segments 26$b_1$, 26$b_2$ and 26$b_3$ are separated, are changed depending on the size of the steel band 30 in the width direction.

The gas wiping nozzle 26*a*, which communicates with the inside of the tubular member 25*a*, is configured such that gas sent from an exterior into the tubular member 25*a* through the above-mentioned gas pipe (not shown) is sprayed from the tips of the gas wiping nozzle 26*a* (the tips of the first, second, and third spraying segments 26$a_1$, 26$a_2$, 26$a_3$) toward the surface of the steel band 30. In a similar fashion, the tubular member 25*b*, which communicates with the gas wiping nozzle 26*b*, is configured such that gas sent from an exterior into the tubular member 25*b* through the above-mentioned gas pipe (not shown) is sprayed from the tips of the gas wiping nozzle 26*b* (the tips of the fourth, fifth, and sixth spraying segments 26$b_1$, 26$b_2$, 26$b_3$) toward the surface of the steel band 30. The end caps 22, 23 have an accordion structure in such a fashion that the gas pipe is movable in a longitudinal and lateral direction in FIG. 3.

According to the structures described above, area A in FIG. 3 surrounded by an imaginary line (not shown) connecting the imaginary lines 26$a_4$ and 26$b_4$, the second spraying segment 26$a_2$, the fifth spraying segment 26$b_2$, and the inner wall of the end cap 22 of the box-shaped body 20 can be sealed between the spaces above and below the nozzle plane connecting the tips of the gas wiping nozzles 26*a*, 26*b* as a boundary. In the area A, the second spraying segment 26$a_2$ sprays gas in the same direction as that of the first spraying segment 26$a_1$, but the former does not serve as removing excess molten metal adhering on the surface of the steel band 30, and instead, serves as working with the fifth spraying segment 26$b_2$ to seal the area A between the spaces above and below the nozzle plane as a boundary.

In a similar fashion, area B in FIG. 3 surrounded by an imaginary line (not shown) connecting the imaginary lines 26$a_5$ and 26$b_5$, the third spraying segment 26$a_3$, the sixth spraying segment 26$b_3$, and the inner wall of the end cap 22 of the box-shaped body 20 can be sealed between the spaces above and below the nozzle plane connecting the tips of the gas wiping nozzles 26*a*, 26*b* as a boundary. In the area B, the third spraying segment 26$a_3$ sprays gas in the same direction as that of the first spraying segment 26$a_1$, but the segment 26$a_3$ does not serve as removing excess molten metal adhering on the surface of the steel band 30, and instead, serves as working with the sixth spraying segment 26$b_3$ to seal the area B between the spaces above and below the nozzle plane as a boundary.

Figure 4:
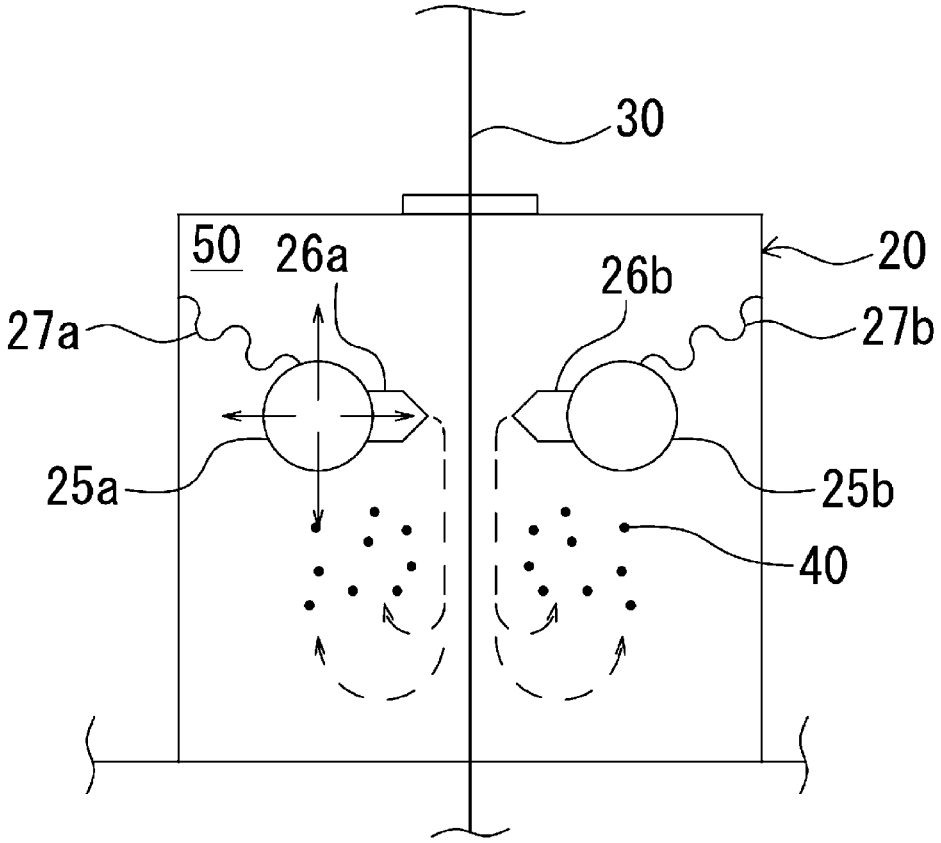
FIG. 4 is an enlarged view of the box-shaped body in the gas wiping device shown in FIG. 1.

As shown by arrows around the tubular member 25*a* in FIG. 4, the tubular member 25*a* is configured such that it is movable in a longitudinal and lateral direction in FIG. 4, and that, for example, the gas wiping nozzle 26*a* is allowed to move while maintained substantially in parallel with the gas wiping nozzle 26*b*. A distance between the gas wiping nozzle 26*a* and the gas wiping nozzle 26*b* is adjusted as one of the ways to control the thickness of molten metal plating formed on the steel band 30. In a similar fashion (not shown) to that of the tubular member 25*a*, the tubular member 25*b* is also configured such that it is movable in a longitudinal and lateral direction in FIG. 4. The distance between the gas wiping nozzle 26*a* and the gas wiping nozzle 26*b* can be changed within a predetermined range by moving one or both of the gas wiping nozzles 26*a*, 26*b* in a lateral direction in FIG. 4.

The accordion curtains 27*a*, 27*b* each serving as a partition member is made of elastic heat-resistant material, that may be either metallic member or non-woven cloth like member. By such accordion curtains 27*a*, 27*b*, a gap between the tubular member 25*a* and the inner wall (an inner wall closer to the tubular member 25*a*) of the box-shaped body 20, and a gap between the tubular member 25*b* and the inner wall (an inner wall closer to the tubular member 25*b*) of the box-shaped body 20 can be sealed, respectively. As an alternative to such an accordion curtain, another partition member may be partition plates having one fixed to the outer wall of the tubular member 25 and the other fixed to the inner wall of the box-shaped body 20, which are arranged to overlap each other in a vertical direction.

Next, the operation of the gas wiping device 100 will be described. As shown in FIG. 1, the steel band 30 is conveyed from the outside through an inlet 14 into the plating bath 10 to be immersed in molten metal 11 in the plating bath 10. Subsequently, the steel band 30 is sent through the main-roller 12 and sub-rollers 13*a*, 13*b* into the box-shaped body 20. The steel band 30 conveyed into the box-shaped body 20 is allowed to pass through between the gas wiping nozzles 26*a*, 26*b*, and is sent from the outlet 24 (see FIG. 2A) to the outside of the box-shaped body 20. When passing between the gas wiping nozzles 26*a*, 26*b*, gas is sprayed to the steel band 30 from the gas wiping nozzles 26*a*, 26*b* via the tubular members 25*a*, 25*b* in order to remove excess molten metal 11 adhering on the surface of the steel band 30, thereby adjusting the thickness of the plated layer of molten metal 11 to reach the intended thickness. As shown in FIG. 4, such an operation generates splashes 40 flying around in the box-shaped body 20 (more specifically, below the nozzle plane). Therefore, the splashes must be prevented from moving toward the passage of the steel band 30 located above the nozzle plane.

However, as mentioned above, the gas wiping nozzles 26*a*, 26*b* moving in a longitudinal and lateral direction in FIG. 4, which makes it difficult to seal a gap between the gas wiping nozzles 26*a*, 26*b* at both ends in the width direction of the gas wiping nozzles 26*a*, 26*b*. In this regard, the gas wiping device in this embodiment, as mentioned above, has the second and fifth spraying segments 26$a_2$, 26$b_2$ configured to seal a gap at one ends of the gas wiping nozzles 26*a*, 26*b* by spraying gas, and the third and sixth spraying segments 26$a_3$ and 26$b_3$ configured to seal a gap at the other ends of the gas wiping nozzles 26*a*, 26*b* by spraying gas. As a result, the device can prevent splashes 40 at both ends of the gas wiping nozzles 26*a*, 26*b* from flying away, and as a consequence, from moving toward the upper space 50 in the box-shaped body 20.

Gaps between the gas wiping nozzles 26*a*, 26*b* might be sealed by disposing blocking members to block a gap between the gas wiping nozzles 26*a*, 26*b*. As mentioned above, however, the gas wiping nozzle 26*a* and/or the gas wiping nozzle 26*b* are movable. In addition, the high temperature around the gas wiping nozzles may cause a deformation of such blocking members to seal a gap between the gas wiping nozzles 26*a* and 26*b*, which would possibly cause adverse effects (e.g. the deformed blocking member contacts the steel band 30, or the like). In this regard, the gas wiping device 100 in this embodiment poses no obstruction to a parallel shift of the gas wiping nozzle 26*a* and/or the gas wiping nozzle 26*b* irrespective of whether the distance is the maximum or minimum distance between the gas wiping nozzles 26*a*, 26*b*. Thus, gaps at both ends in the width direction of the gas wiping nozzles 26*a*, 26*b* can be constantly sealed irrespective of any distance between the gas wiping nozzles, and splashes generated below the nozzle plane can be prevented from moving toward the passage of the steel band 30 located above the nozzle plane. In addition, the device is free from concern about problems such as those caused by thermally deformed members contacting the steel band 30, which may occur if the device has blocking members to seal a gap between the gas wiping nozzles 26*a*, 26*b*.

In addition, the accordion curtains 27*a*, 27*b* close a gap between the tubular member 25*a* and the inner wall of the box-shaped body 20 (the inner wall closer to the tubular member 25*a*), and a gap between the tubular member 25*b* and the inner wall of the box-shaped body 20 (the inner wall closer to the tubular member 25*b*), thereby preventing splashes 40 from flying away to the upper space 50 of the box-shaped body 20. As a result, splashes generated below the nozzle plane are prevented from moving toward the passage of the steel band 30 located above the nozzle plane. In view of the prevention of splashes, it is preferable that the accordion curtains 27*a*, 27*b* cover their whole respective areas in the width direction of the box-shaped body 20 (i.e. the width direction of the steel band 30).

Furthermore, since the gas (e.g. nitrogen gas) is sprayed between the gas wiping nozzles 26*a*, 26*b*, splashes generated below the nozzle plane can be prevented from moving toward the passage of the steel band 30 located above the nozzle plane.

EXAMPLES

Hot-dipped-Zn 6-mass %-Al 2.9-mass %-Mg system plated steel sheets were manufactured by using the gas wiping device shown in FIG. 2B. As a comparative example, hot-dipped-Zn 6-mass %-Al 2.9-mass %-Mg system plated steel sheets were manufactured by using a gas wiping device obtained by removing the spraying segments 26 from the gas wiping device shown in FIG. 2B. Table 1 shows the ratio of the number of spots generated by crystallization of the $Zn_{11}Mg_2$ system phase per unit area on the plated steel sheets manufactured under the conditions that the ratio of the number of spots generated in the comparative example is set at 1. The results show that the gas wiping device according to the present invention can greatly reduce the occurrence of a splash-induced spotty appearance.

TABLE 1

| | Present invention | Comparative example |
|---|---|---|
| Generated spot number ratio | 0.5 | 1 |

As described above, the gas wiping device 100 in this embodiment has the curtains sealing a gap between the tubular member 25*a* and the inner wall of the box-shaped body 20 (closer to the tubular member 25*a*), and a gap between the tubular member 25*b* and the inner wall of the box-shaped body 20 (closer to the tubular member 25*b*), thereby preventing splashes from moving through the gaps toward the passage of the steel band 30 located above the nozzle plane. The device also prevents splashes at both ends in the width direction of the gas wiping nozzles 26*a*, 26*b* from moving between the gas wiping nozzles toward the passage of the steel band 30 located above the nozzle plane. As a result, splashes generated below the nozzle plane are prevented in all areas except for the nozzle widths of the gas wiping nozzles 26*a*, 26*b* arranged to face each other, from moving toward the passage of a steel band 30 located above the nozzle plane. Therefore, even equipped with a box-shaped body 20 housing the gas wiping nozzles 26*a*, 26*b*, the device can reduce the adhesion of splashes on the surface of the steel band 30 after excess molten metal is removed from the steel band 30 by the gas wiping nozzles 26*a*, 26*b*, thereby suppressing the increase of splash-induced spots.

In addition, the splashes can be prevented from moving toward the passage of the steel band located above the nozzle plane irrespective of the distance between the gas wiping nozzles 26*a*, 26*b*. There is no obstruction to a parallel shift of the gas wiping nozzle 26*a* and/or the gas wiping nozzle 26*b*.

Examples of Modifications

Figure 5:
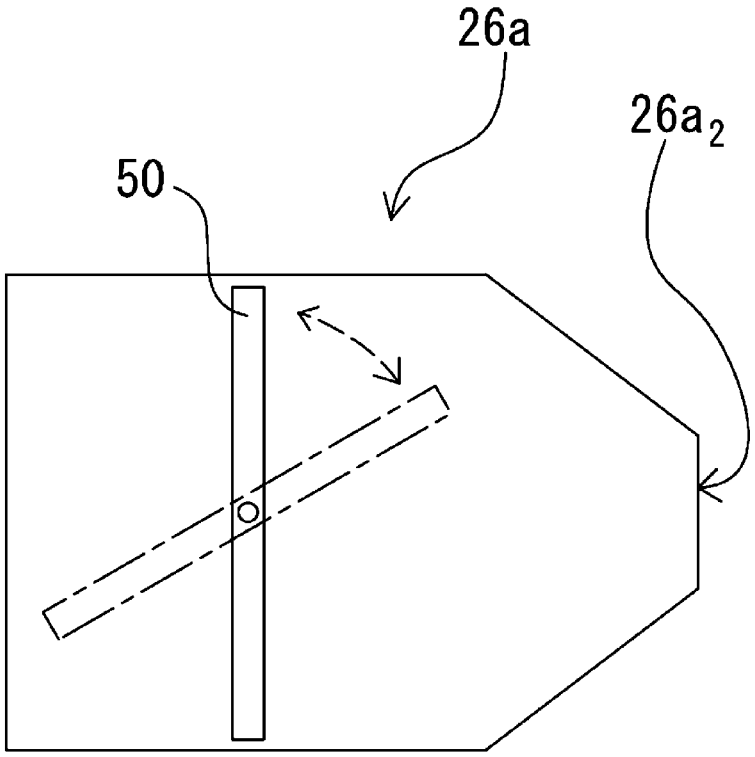
FIG. 5 is a schematic sectional view of gas wiping nozzles in a gas wiping device as a modification of the present invention.

The present invention is not limited to the embodiments described above, but its scope includes various modifications allowable in accordance with the intent of the present invention. For example, the slit width may be smaller for the segment (the second spraying segment $\mathbf{26}a_2$), which does not spray gas on the steel band 30 even when the steel band 30 of the maximum width passes between the gas wiping nozzles 26*a*, 26*b* than that of the first spraying segment $\mathbf{26}a_1$ because the segment sprays gas whose amount is sufficient for sealing. In a similar fashion, the slit width of nozzles for the third, fifth, and sixth spraying segments $\mathbf{26}a_3$, $\mathbf{26}b_2$, $\mathbf{26}b_3$ may be smaller (limited to the segment that does not spray gas on the steel band 30 even when the steel band 30 of the maximum width passes) than those of the first and fourth spraying segments $\mathbf{26}a_1$, $\mathbf{26}b_1$. Since the second, third, fifth, and sixth spraying segments $\mathbf{26}a_2$, $\mathbf{26}a_3$, $\mathbf{26}b_2$, $\mathbf{26}b_3$ spray gas for the purpose of sealing instead of spraying gas on the steel band 30, it is possible to discourage excessive gas consumption by allowing the segments to regulate the spraying amount of gas while preventing splashes at both ends in the width direction of the gas wiping nozzles 26*a*, 26*b* from moving toward the passage of the steel band located above the nozzle plane. In particular, even when at least one of the gas wiping nozzles 26*a*, 26*b* is movable in parallel with the other, gaps at both ends in the width direction of the steel band 30 are sealed by gas. Thus, splashes can be prevented from moving toward the passage of the steel band 30 located above the nozzle plane at all times irrespective of any distance between the gas wiping nozzles 26*a*, 26*b*. The flow rate of gas sprayed from the second, third, fifth and sixth spraying segments $\mathbf{26}a_2$, $\mathbf{26}a_3$, $\mathbf{26}b_2$, $\mathbf{26}b_3$ can be regulated e.g. by using variable gap nozzles. In addition, methods to regulate the flow rate of gas sprayed from the second, third, fifth, and sixth spraying segments $\mathbf{26}a_2$, $\mathbf{26}a_3$, $\mathbf{26}b_2$, $\mathbf{26}b_3$ are not limited to methods by reducing the slit width of their nozzles to less than that of the first and fourth spraying segments $\mathbf{26}a_1$, $\mathbf{26}b_1$. For example, a gas regulating unit may also be used to regulate the amount of gas to be sprayed by disposing planar members 50 with an adjustable inclination angle in the vicinity of the second, third, fifth, and sixth spraying segments $\mathbf{26}a_2$, $\mathbf{26}a_3$, $\mathbf{26}b_2$, $\mathbf{26}b_3$ (see FIG. 5). It must be noted that the gas regulating unit is not limited to the one shown in FIG. 5. The unit may be in any form as long as it can regulate the spraying amount of gas.

REFERENCE NUMERALS

10 plating bath
11 molten metal
12 main-roller
13*a*, 13*b* sub-rollers
14 inlet
20 box-shaped body
21 main body
22, 23 end caps
24 outlet
25*a*, 25*b* tubular members

26*a*, 26*b* gas wiping nozzles
26*a*$_1$ first spraying segment
26*a*$_2$ second spraying segment
26*a*$_3$ third spraying segment
26*b*$_1$ fourth spraying segment
26*b*$_2$ fifth spraying segment
26*b*$_3$ sixth spraying segment
27*a*, 27*b* accordion curtains
30 steel band
31 sealing curtain
40 splashes
50 upper space
100 gas wiping device

What is claimed is:

1. A gas wiping device comprising:

a first gas wiping nozzle and a second gas wiping nozzle arranged to face each other across a steel band pulled up from a molten-metal plating bath, the first and second gas wiping nozzles configured to remove excess molten metal adhering on a surface of the steel band;

a first tubular member disposed along a width direction of the steel band, the first tubular member connected to the first gas wiping nozzle;

a second tubular member disposed along a width direction of the steel band, the second tubular member connected to the second gas wiping nozzle;

a box-shaped body housing the first and second gas wiping nozzles, and the first and second tubular members;

a first partition member having one end thereof fixed to an outer wall of the first tubular member, and having the other end thereof fixed to an inner wall of the box-shaped body; and a second partition member having one end thereof fixed to an outer wall of the second tubular member, and having the other end thereof fixed to an inner wall of the box-shaped body, wherein the first gas wiping nozzle includes a first spraying segment configured to spray gas over a range as a whole in a width direction of the steel band, a second spraying segment configured to spray gas toward the second gas wiping nozzle over a range from one end of the first spraying segment to one inner wall of the box-shaped body in a width direction of the box-shaped body, and a third spraying segment configured to spray gas toward the second gas wiping nozzle over a range from the other end of the first spraying segment to the other inner wall of the box-shaped body in a width direction of the box-shaped body, and wherein the second gas wiping nozzle includes a fourth spraying segment configured to spray gas over a range as a whole in a width direction of the steel band, a fifth spraying segment configured to spray gas toward the first gas wiping nozzle, from over a range from one end of the fourth spraying segment to one inner wall of the box-shaped body in a width direction of the box-shaped body, and a sixth spraying segment configured to spray gas toward the first gas wiping nozzle over a range from the other end of the fourth spraying segment to the other inner wall of the box-shaped body in a width direction of the box-shaped body.

2. The gas wiping device according to claim 1, wherein the second and third spraying segments are configured such that gas sprayed therefrom is smaller in amount than gas sprayed from the first spraying segment, and wherein the fifth and sixth spraying segments are configured such that gas sprayed therefrom is smaller in amount than gas sprayed from the fourth spraying segment.

3. The gas wiping device according to claim 1, wherein at least one of the first and second gas wiping nozzles is configured to move relative to the other while being in parallel with the other so that a distance therebetween can be changed within a predetermined range, and wherein said gas wiping device further comprises a gas regulating unit configured to regulate a spraying amount of gas in accordance with a distance between the first and second gas wiping nozzles, wherein gas sprayed from the second spraying segment and gas sprayed from the fifth spraying segment contact each other, and gas sprayed from the third spraying segment and gas sprayed from the sixth spraying segment contact each other.

* * * * *